US007647900B2

(12) United States Patent
Hayashi et al.

(10) Patent No.: US 7,647,900 B2
(45) Date of Patent: Jan. 19, 2010

(54) ENGINE COOLING APPARATUS

(75) Inventors: Kunihiko Hayashi, Odawara (JP); Hideo Kobayashi, Mishima (JP); Katuhiko Arisawa, Gotenba (JP); Kenichi Yamada, Yaizu (JP); Yoshio Yamashita, Toyota (JP)

(73) Assignee: Toyota Jidosha Kabuhsiki Kaisha, Toyota-shi (JP)

( * ) Notice: Subject to any disclaimer, the term of this patent is extended or adjusted under 35 U.S.C. 154(b) by 174 days.

(21) Appl. No.: 11/806,765

(22) Filed: Jun. 4, 2007

(65) Prior Publication Data

US 2007/0295289 A1 Dec. 27, 2007

(30) Foreign Application Priority Data

Jun. 5, 2006 (JP) ..... 2006-156068

(51) Int. Cl.
*F01P 3/02* (2006.01)
*F01P 7/16* (2006.01)
*F02F 1/14* (2006.01)

(52) U.S. Cl. ..... 123/41.72; 123/41.82 R

(58) Field of Classification Search ..... 123/41.67, 123/41.68, 41.74, 41.75, 145.5 R, 142.5 E, 123/41.05, 41.08, 41.28, 41.44, 41.72, 41.81, 123/41.82 R; 165/51

See application file for complete search history.

(56) References Cited

U.S. PATENT DOCUMENTS

| | | | | |
|---|---|---|---|---|
| 5,022,662 | A | 6/1991 | Yasui | |
| 2003/0230253 | A1 | 12/2003 | Matsutani et al. | |
| 2004/0262411 | A1 * | 12/2004 | Tsukamoto et al. | 236/101 C |

FOREIGN PATENT DOCUMENTS

| | | | |
|---|---|---|---|
| DE | 100 11 143 | A1 | 9/2001 |
| FR | 2 436 878 | A | 4/1980 |
| GB | 2 286 039 | A | 8/1995 |
| JP | 2003-003905 | A | 1/2003 |
| JP | 2003-172140 | A | 6/2003 |
| JP | 2003-201842 | A | 7/2003 |
| JP | 2004-124893 | A | 4/2004 |
| JP | 2004-346928 | A | 12/2004 |
| JP | 2005256660 | A | 9/2005 |
| JP | 2005291005 | A | 10/2005 |
| JP | 2005315118 | A | 11/2005 |

* cited by examiner

*Primary Examiner*—M. McMahon
(74) *Attorney, Agent, or Firm*—Kenyon & Kenyon LLP

(57) ABSTRACT

An engine cooling apparatus includes a coolant inlet of a block water jacket formed in a cylinder block, wherein coolant is introduced into the block water jacket through the coolant inlet, a flow-directing plate that is disposed in the block water jacket at a position downstream of the coolant inlet, and that directs the coolant, which has been introduced into the block water jacket through the coolant inlet, toward a head water jacket and a control portion that controls inflow of the coolant from the head water jacket into the block water jacket.

9 Claims, 9 Drawing Sheets

ENGINE COOLING APPARATUS

INCORPORATION BY REFERENCE

The disclosure of Japanese Patent Application No. 2006-156068 filed on Jun. 5, 2006, including the specification, drawings and abstract is incorporated herein by reference in its entirety.

BACKGROUND OF THE INVENTION

1. Field of the Invention

The invention relates to an engine cooling apparatus that effectively warms and cools the engine.

2. Description of the Related Art

When warming-up has not been completed, for example, great friction is caused in an engine. Therefore, the warming-up needs to be quickly completed. In particular, components having slide portions, such as cylinder bores, pistons, and a crankshaft, need to be quickly warmed to efficiently operate the engine. In an ordinary engine, when air-fuel mixture starts to be ignited in the cylinder, engine components such as a cylinder block and a cylinder head, and engine oil that is circulated in oil passages formed in the engine components, and coolant that is circulated in a water jacket are warmed. Thus, the warming-up gradually proceeds.

Also, a cooling apparatus is provided in an engine to avoid an excessive increase in the temperature of each portion of the engine after the warming-up is completed.

There are various types of engine cooling apparatuses. For example, a so-called separation cooling system, which separately cools a cylinder block and a cylinder head, is proposed. Further, Japanese Patent Application Publication No. 2004-346928 (JP-A-2004-346928) describes a cooling system that is configured by improving the separation cooling system.

To reduce the amount of pollutants in exhaust gas, it is necessary to improve the effect of cooling the cylinder head of an engine. Also, it is necessary to improve the effect of warming the cylinder block during cold start. In the above-described separation cooling system, the effect of cooling the cylinder head is improved. However, because a water pump is generally provided in the cylinder block of an engine, a pipe or a jacket needs to be newly provided so that the coolant flows directly into a head water jacket from the water pump. In this case, the heat capacity of the pipe or the jacket that is newly provided is added to the heat capacity of the block water jacket. Therefore, the heat capacity is increased. This increase in the heat capacity is not desirable, because the effect of warming the cylinder block needs to be improved. Such a problem may arise also in the engine cooling system described in the above-described publication. Thus, improvement needs to be made to achieve both of the effect of cooling the cylinder head and the effect of warming the cylinder block during engine cold start.

SUMMARY OF THE INVENTION

The invention provides an engine cooling apparatus that produces the effect of efficiently cooling an engine, while the engine is quickly warmed up.

An aspect of the invention relates to an engine cooling apparatus that includes a coolant inlet of a block water jacket formed in a cylinder block, wherein coolant is introduced into the block water jacket through the coolant inlet; a flow-directing plate that is disposed in the block water jacket at a position downstream of the coolant inlet, and that directs the coolant, which has been introduced into the block water jacket through the coolant inlet, toward a head water jacket; and a control portion that controls inflow of the coolant from the head water jacket into the block water jacket. In the above-described aspect, after the coolant is introduced into the block water jacket provided in the cylinder block, the coolant passes through only a small portion of the block water jacket, and then flows into the cylinder head. Therefore, it is not necessary to provide a pipe or the like that directs the coolant, which has been delivered from a water pump, toward the head water jacket. Also, the amount of coolant is not increased. Further, because the coolant scarcely flows in the block water jacket, heat is not carried away by the flow of coolant. This improves the effect of warming the cylinder block.

In the above-described aspect, the flow-directing plate may form a part of a spacer in the block water jacket. By fitting the spacer into the block water jacket, it is possible to adjust a coolant passage in the water jacket, and to produce a heat-insulation effect. Also, by fitting the spacer into the block water jacket, it is possible to reduce the volume of coolant in the block water jacket.

Such a spacer may divide the inside of the block water jacket into a coolant introduction portion connected to the coolant inlet, and a coolant inflow portion into which the coolant flows from the head water jacket. In this case, the coolant introduction portion forms a passage through which the coolant supplied from the water pump flows into the head water jacket. Accordingly, immediately after the coolant flows into the block water jacket, the coolant flows into the head water jacket through the coolant introduction portion. The coolant inflow portion is a space into which the coolant, which has dropped from the head water jacket, flows. The coolant inflow portion occupies a large area of the block water jacket. By using such a water jacket spacer, it is possible to direct the coolant supplied from the water pump to flow through the coolant introduction portion, the head water jacket, and the coolant inflow portion in the stated order. As a result, it is possible to improve the effect of cooling the cylinder head and the effect of warming the cylinder block during engine cold start.

In the engine cooling apparatus according to the above-described aspect, the flow of coolant is suppressed, and accordingly the coolant stagnates in the block water jacket during the engine cold start so that the effect of warming the cylinder block is improved during the engine cold start. However, after the warming-up of the engine is completed, the coolant needs to flow in the block water jacket to cool the cylinder block. Thus, the engine cooling apparatus according to the invention includes the control portion that controls the inflow of the coolant from the head water jacket into the block water jacket. The control portion may be a control valve that switches between a first circulation passage in which the coolant flows into the head water jacket, and then flows out of the head water jacket, and a second circulation passage in which the coolant flows into the block water jacket from the head water jacket, and then flows out of the block water jacket, according to the temperature of the coolant.

When the above-described water jacket spacer is fitted into the block water jacket such that the coolant introduction portion and the coolant inflow portion are formed in the block water jacket, the control portion may be a control valve that is provided in a coolant passage through which the coolant flows into the coolant inflow portion, and that controls the inflow of the coolant into the coolant inflow portion, according to the temperature of the coolant. For example, a cover portion may be formed on the coolant inflow portion to prevent the coolant from flowing from the head water jacket into the coolant inflow portion. In this case, the control valve is provided in the cover portion, and is opened/closed according to the temperature of the coolant. With this configuration, it is possible to reduce the possibility that the coolant, which has been warmed in the block water jacket, flows into the head water jacket during cold start. As a result, the effect of warming the cylinder block is further improved.

In the above-described configuration, the control valve may be formed using bimetal. Further, in this configuration, a heating device that heats the bimetal may be provided. A temperature, at which the bimetal is heated by the heating device, may be controlled according to the temperature of the coolant.

In the engine cooling apparatus according to the above-described aspect, the flow of the coolant in the block water jacket is suppressed during cold start. After the warming-up is completed, the coolant flows in the block water jacket to improve the effect of cooling the cylinder block. Thus, the flow-directing plate may be provided with an open/close valve that is opened/closed according to the temperature of the coolant so that the coolant flows in the entire area of the block water jacket without passing through the head water jacket, after the warming-up is completed.

In the above-described configuration, the open/close valve may be formed using bimetal. Further, in the above-described configuration, a heating device that heats the bimetal may be provided. A temperature, at which the bimetal is heated by the heating device, may be controlled according to the temperature of the coolant.

According to the invention, immediately after the coolant passes through a part of the block water jacket formed in the cylinder block, the coolant flows into the head water jacket during the engine cold start. After the warming-up is completed, the coolant flows in the block water jacket. Thus, it is possible to effectively warm up and cool the engine.

BRIEF DESCRIPTION OF THE DRAWINGS

The foregoing and/or further objects, features and advantages of the invention will become more apparent from the following description of example embodiment with reference to the accompanying drawings, in which like numerals are used to represent like elements and wherein.

DETAILED DESCRIPTION OF THE EXAMPLE EMBODIMENTS

In the following description, the present invention will be described in more detail in terms of exemplary embodiments.

Figure 1:
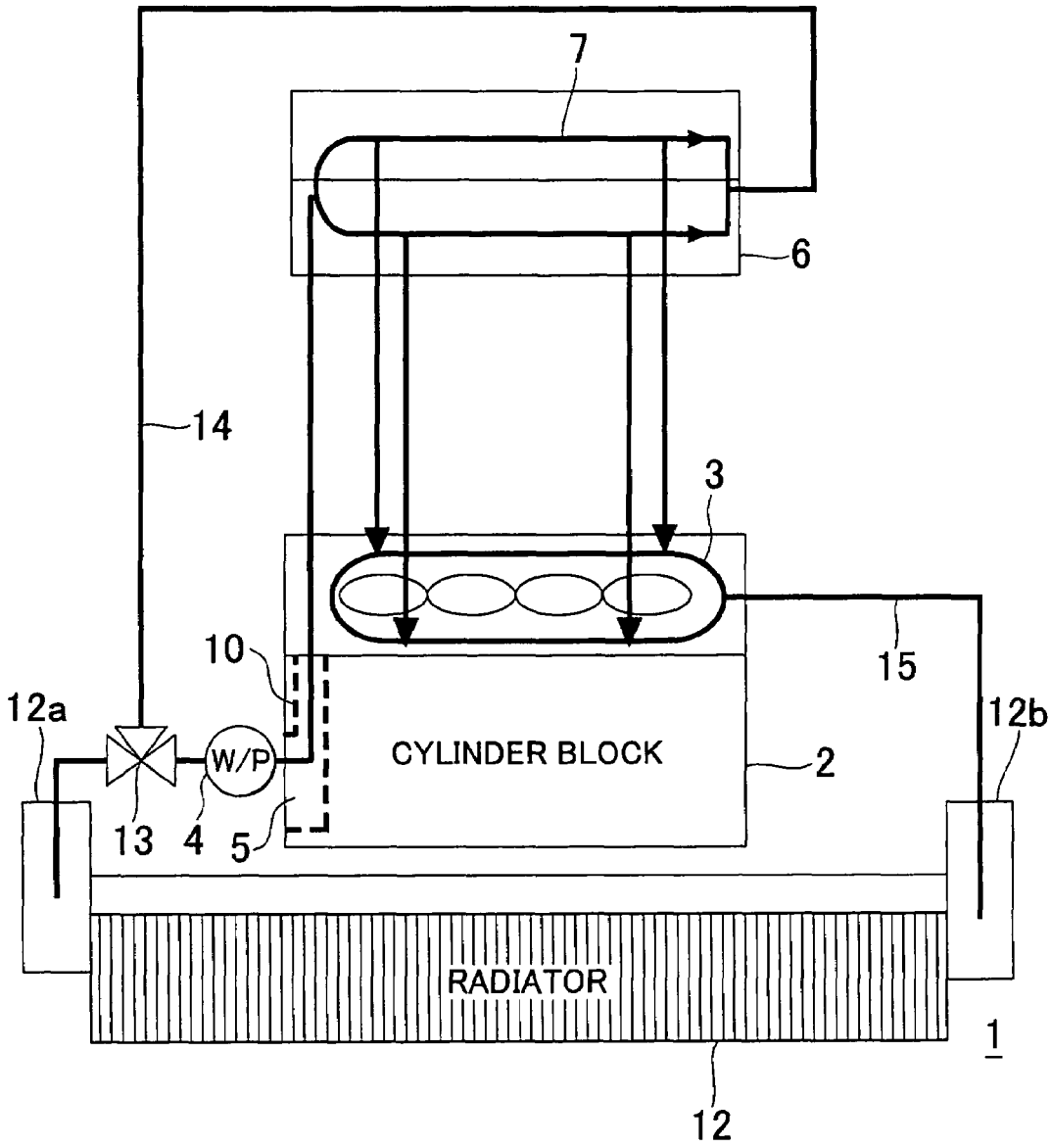
FIG. 1 is a schematic diagram of an engine provided with a cooling apparatus according to an embodiment.

FIG. 1 is a schematic diagram showing a four-cylinder engine 1 provided with an engine cooling apparatus according to an embodiment of the invention. In a cylinder block 2 that constitutes the engine 1, a block water jacket 3 is formed. The block water jacket 3 includes a coolant inlet 5 through which coolant supplied from a water pump 4 is introduced into the block water jacket 3. In a cylinder head 6, a head water jacket 7 is formed.

Figure 2:
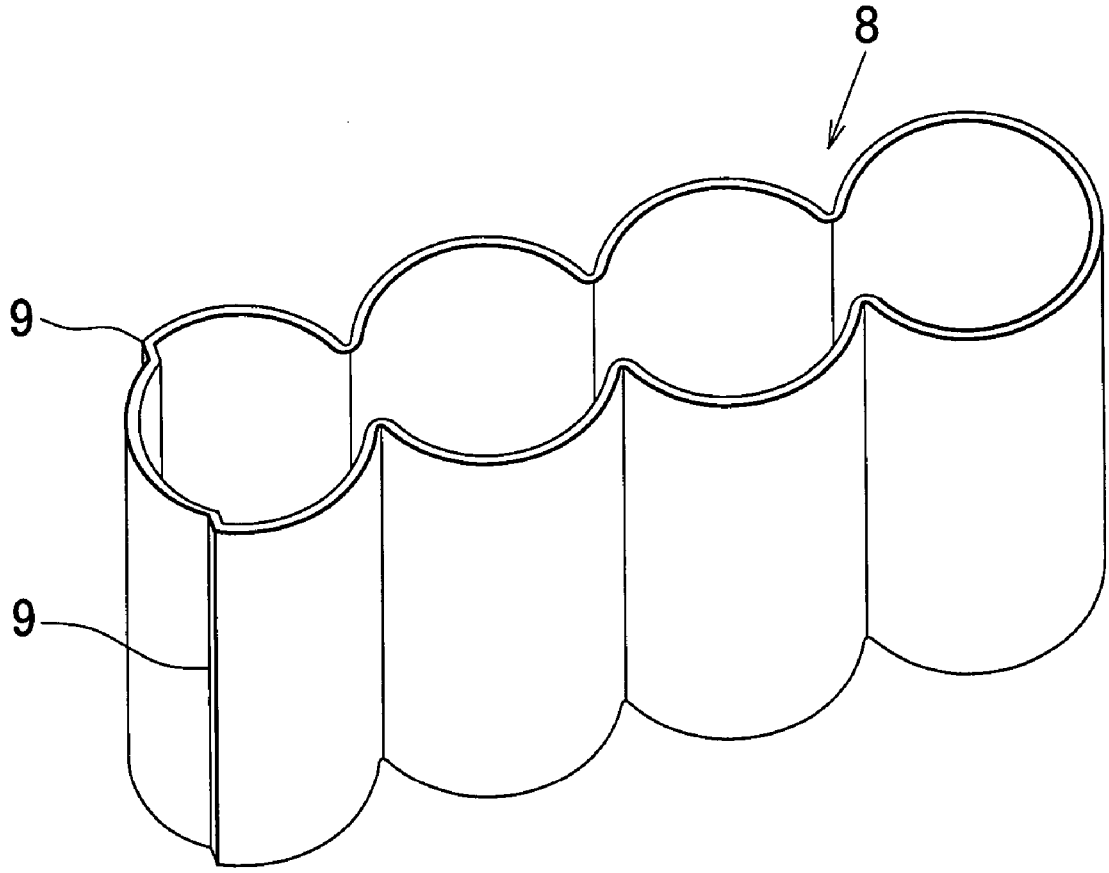
FIG. 2 is a perspective view of a water jacket spacer.
Figure 3A:
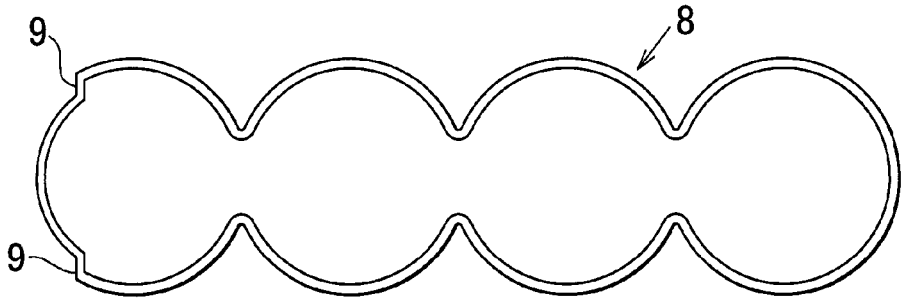
FIG. 3A is a plan view showing the water jacket spacer.
Figure 3B:
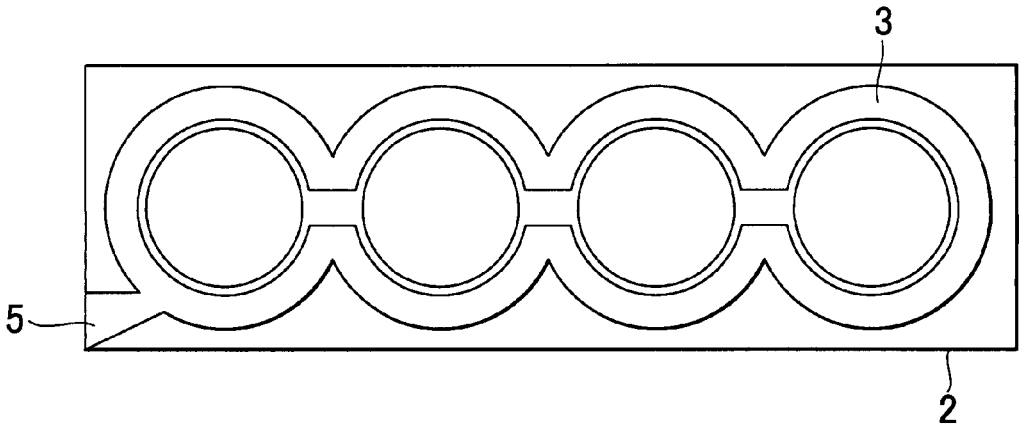
FIG. 3B is a plan view showing a cylinder block.
Figure 3C:
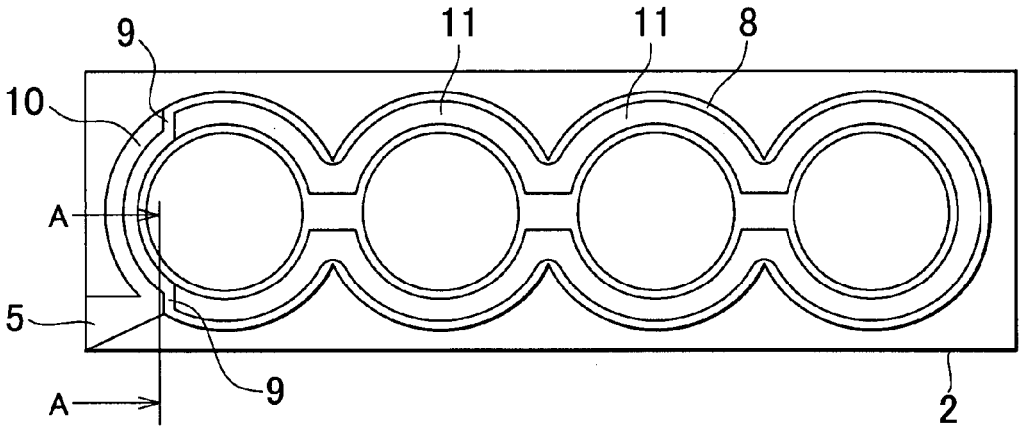
FIG. 3C is a plan view showing the cylinder block in which the water jacket spacer is fitted into a block water jacket.

FIG. 2 is a perspective view showing a water jacket spacer 8 fitted into the block water jacket 3. FIG. 3A is a plan view showing the water jacket spacer 8. FIG. 3B is a plan view showing the cylinder block 2. FIG. 3C is a plan view showing the cylinder block 2 in which the water jacket spacer 8 is fitted into the block water jacket 3. Flow-directing plates 9 are formed integrally with the water jacket spacer 8. In this embodiment, as shown in FIG. 3C, the flow-directing plates 9 are formed at two positions that are downstream of the coolant inlet 5 when the water jacket spacer 8 is fitted into the block water jacket 3. A recessed portion is formed between the two positions at which the flow-directing plates 9 are formed. The water jacket spacer 8 is disposed such that many portions of the water jacket spacer 8 other than the recessed portion contact the inner wall of the cylinder block 2. Thus, as shown in FIG. 3C, when the water jacket spacer 8 is fitted into the block water jacket 3, the inside of the block water jacket 3 is divided into a coolant introduction portion 10 connected to the coolant inlet 5, and a coolant inflow portion 11 into which the coolant flows from the head water jacket 7. The coolant inflow portion 11 is formed in an area of the block water jacket 3, which is close to bores.

The engine 1 includes a radiator 12. A thermostat 13 is provided downstream of the outlet 12*a* of the radiator 12. The water pump 4 is disposed downstream of the thermostat 13. The thermostat 13 is connected to a return passage 14 that extends from the head water jacket 7. The thermostat 13 is a control valve that may be regarded as the control portion according to the invention. The inlet 12*b* of the radiator 12 is connected to a return passage 15 that extends from the block water jacket 3. When the engine 1 is cold, the side of the thermostat 13, which is connected to the outlet 12*a* of the radiator 12, is closed. As a result, the coolant flows in a circulation passage. More specifically, in this circulation passage, the coolant delivered from the water pump 4 flows through the coolant inlet 5, the head water jacket 7, and the return passage 14 in the stated order, to reach the thermostat 13. This circulation passage may be regarded as the first circulation passage according to the invention. After warming-up is completed, the side of the thermostat 13, which is connected to the return passage 14, is closed. As a result, the coolant flows in another circulation passage. More specifically, in this circulation passage, the coolant delivered from the water pump 4 flows through the coolant inlet 5, the head water jacket 7, the block water jacket 3, the return passage 15, and the radiator 1 in the stated order, to reach the thermostat 13. This circulation passage may be regarded as the second circulation passage according to the invention.

Figure 4:
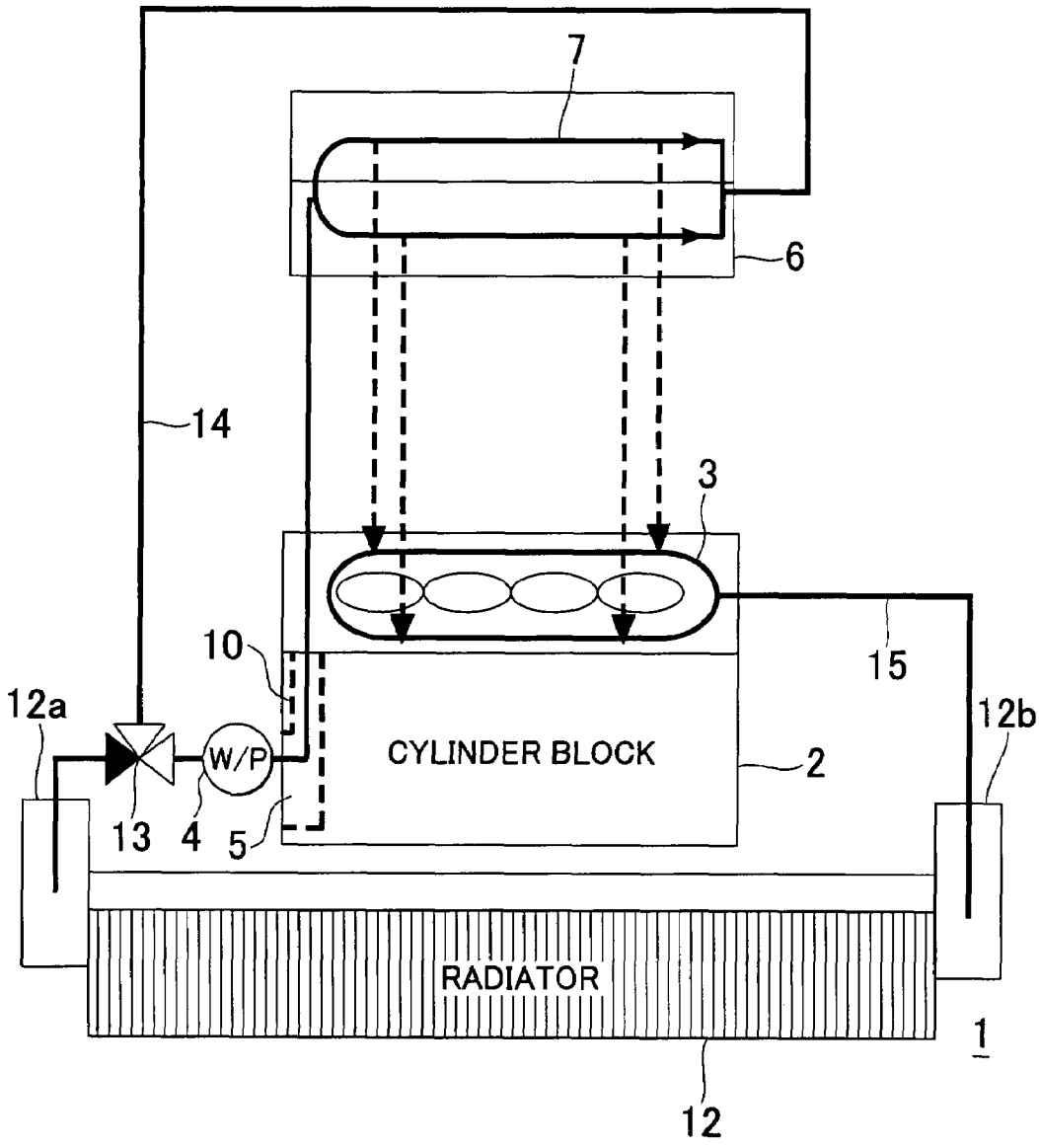
FIG. 4 is a schematic diagram showing the engine in which a thermostat is in a state during cold start.
Figure 5:
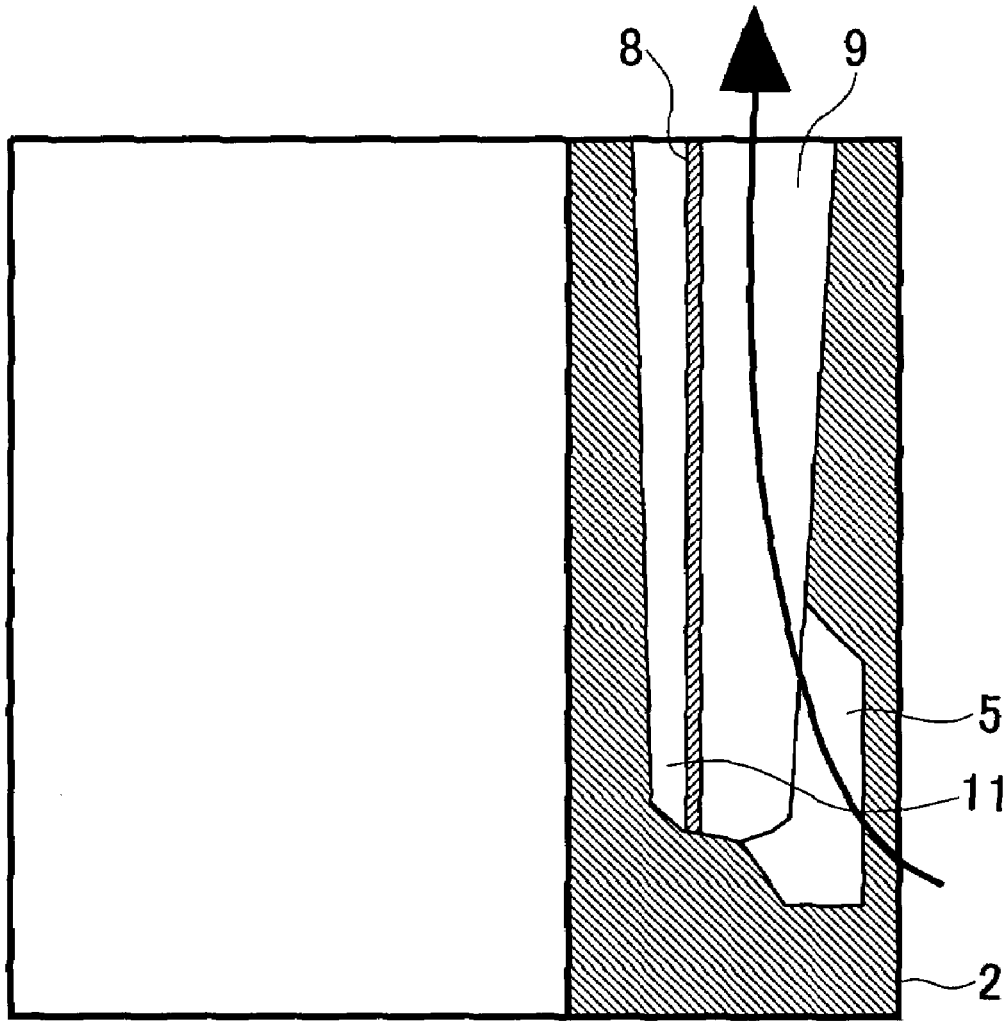
FIG. 5 is a cross sectional view taken along the line A-A in FIG. 1.

The operation of the engine cooling apparatus according to the embodiment will be described. When the engine 1 is cold, the side of the thermostat 13, which is connected to the outlet 12*a* of the radiator 12, is closed, as shown in FIG. 4. If the engine 1 starts in this situation, and the water pump 4 starts to be operated, the coolant flows into the block water jacket 3 through the coolant inlet 5 formed in the cylinder block 2, and then, the coolant is directed upward by the flow-directing plates 9, as shown in FIG. 5 that is the cross sectional view taken along the line A-A in FIG. 3C. Thus, the coolant flows into the head water jacket 7 through the coolant introduction portion 10. In this case, communication is provided between the head water jacket 7 and the coolant inflow portion 11 of the block water jacket 3. However, because the inflow of coolant from the block water jacket 3 into the radiator 12 is suppressed due to the state of the thermostat 13, most part of the coolant delivered from the water pump 4 returns from the head water jacket 7 to the thermostat 13 through the return passage 14, and then, the coolant is delivered again from the water pump 4. That is, when the engine 1 is cold, the coolant flows in the first circulation passage in which the coolant flows into the head water jacket 7, and then flows out of the head water jacket 7.

As described above, although the coolant flows in the head water jacket 7, the coolant stagnates in the block water jacket 3, and almost no coolant newly flows into the block water jacket 3. Therefore, heat is not carried away by the flow of coolant. Thus, the cylinder block 2 is quickly warmed.

Figure 6:
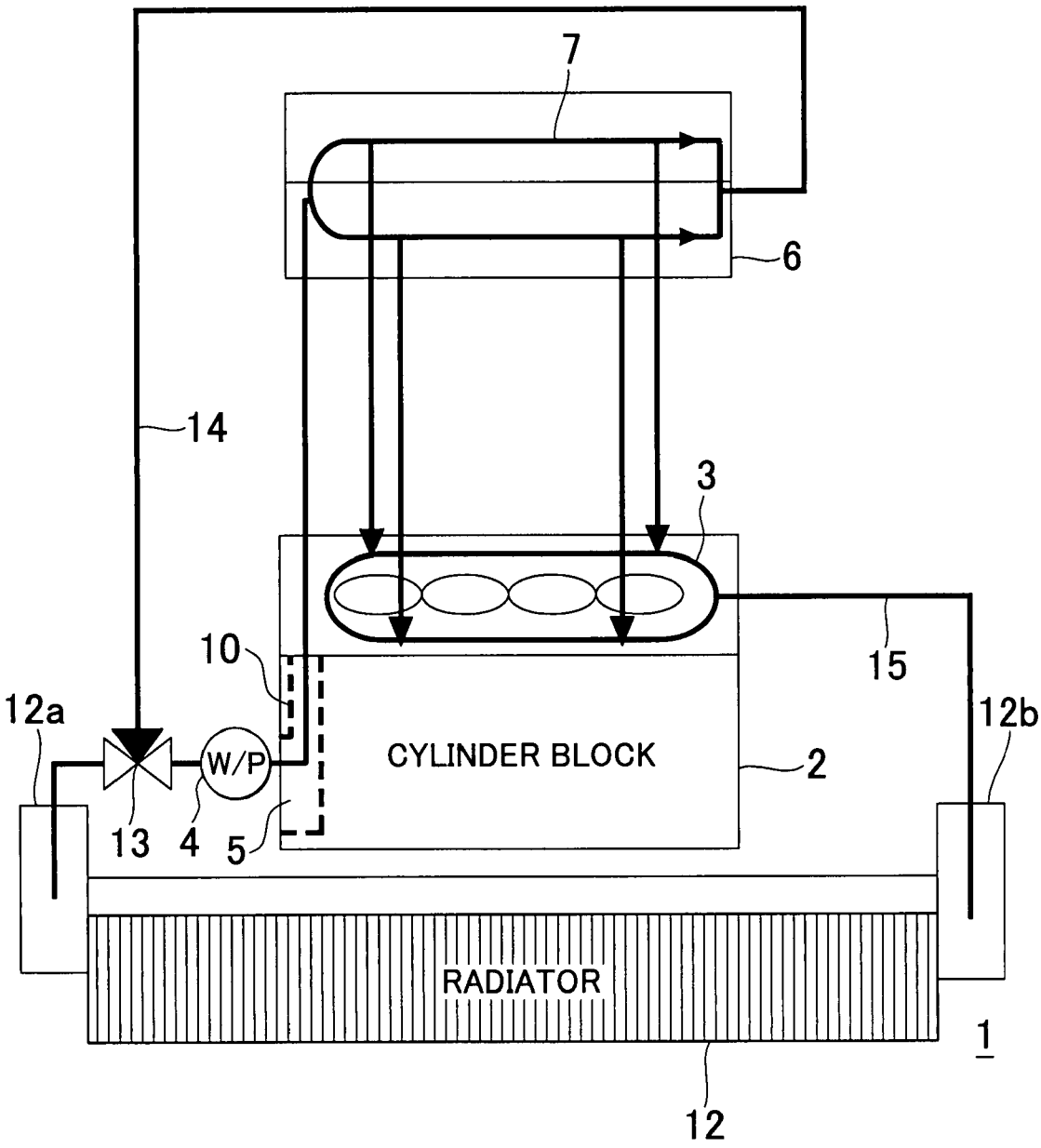
FIG. 6 is a schematic diagram of the engine in which the thermostat is in a state at the completion of warming-up.

The temperature of the coolant that flows in the head water jacket 7 is gradually increased. When the temperature of the coolant in the head water jacket 7 reaches a predetermined temperature, the side of the thermostat 13, which is connected to the return passage 14, is closed, and the side of the thermostat 13, which is connected to the outlet 12*a* of the radiator 12, is opened, as shown in FIG. 6. This enables the coolant to flow into the radiator 12, and to flow out of the radiator 12. As a result, the coolant flows in the block water jacket 3 as well. Thus, the cylinder block 2 is cooled.

The features of the above-described engine cooling apparatus are as follows. Immediately after the coolant is supplied from the water pump 4, the coolant is directed to flow into the head water jacket 7 by the flow-directing plates 9. Also, the coolant scarcely flows in a large area of the block water jacket 3. Therefore, the warming-up of the cylinder block 2 is not inhibited. Also, the water jacket spacer 8 divides the inside of the block water jacket 3 into the coolant introduction portion 10 and the coolant inflow portion 11. This eliminates the need of separately providing a pipe or another water jacket. Thus, there is an advantage relating to cost and the like. Further, by using the water jacket spacer 8, it is possible to reduce the amount of coolant that flows in the block water jacket 8, and to reduce the heat capacity of the block water jacket 8. Also, it is possible to reduce the cross sectional area of the flow passage in the block water jacket 3. This increases the flow speed of the coolant. Thus, it is possible to effectively cool the cylinder block 2, for example, when the engine 1 is operated under high load.

Figure 7:
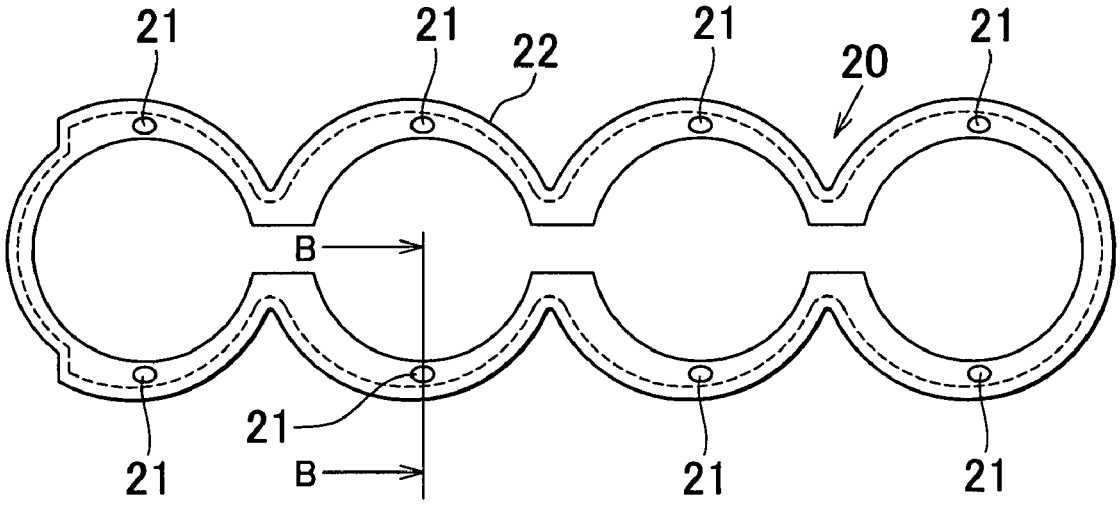
FIG. 7 is a plan view showing a water jacket spacer according to a second embodiment.
Figure 8A:
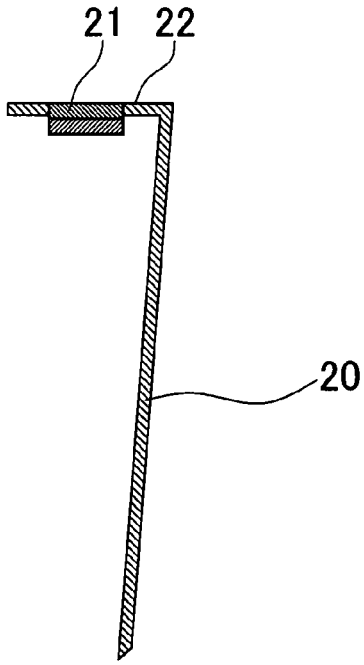
FIG. 8A is a cross sectional view of the water jacket spacer, taken along the line B-B in FIG. 7.
Figure 8B:
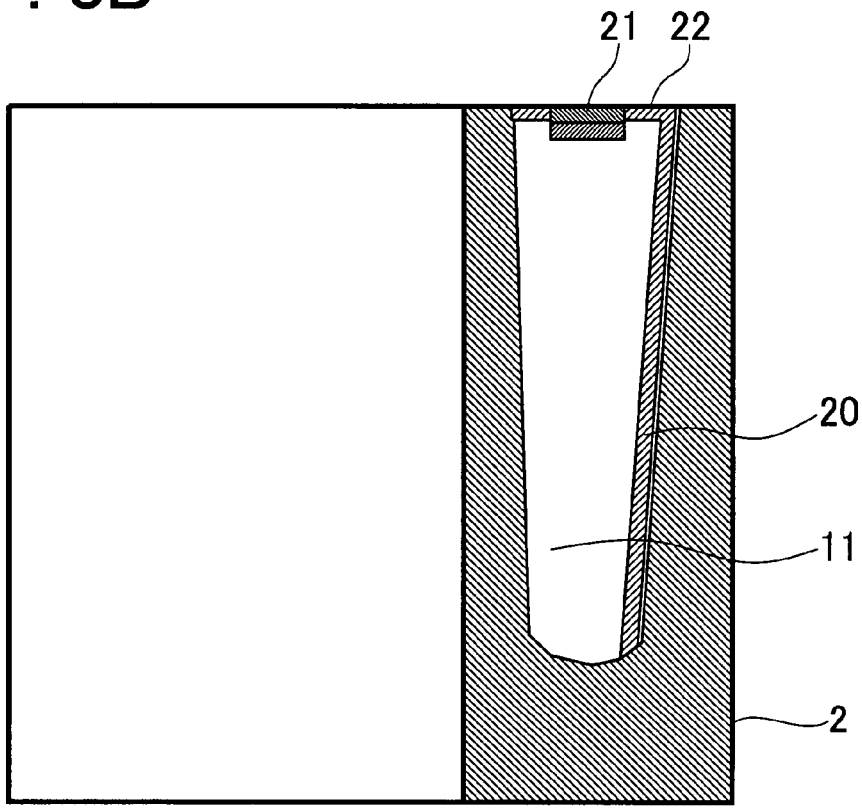
FIG. 8B is a cross sectional view showing a cylinder block in which the water jacket spacer is fitted.

Next, a second embodiment of the invention will be described with reference to FIG. 7 and FIGS. 8A and 8B. FIG. 7 is a plan view showing a water jacket spacer 20 in the second embodiment. FIG. 8A is a cross sectional view of the water jacket spacer 20, taken along the line B-B in FIG. 7. FIG. 8B is a cross sectional view showing the cylinder block 2 in which the water jacket spacer 20 is fitted.

The configuration in the second embodiment is the same as the configuration in the first embodiment, except that the water jacket spacer 20 is provided in a coolant passage through which the coolant flows into the coolant inflow portion 11, and control valves 21 are provided. The control valves 21, which are formed using bimetal, control the inflow of the coolant into the coolant inflow portion 11 according to the temperature of the coolant. The control valves 21 are provided on a cover portion 22 that is formed on the upper edge of the water jacket spacer 20 to cover the upper portion of the coolant inflow portion 11. The control valves 21 may be regarded as the control portion according to the invention.

In the first embodiment, the flow of the coolant in the block water jacket 3 is controlled by changing the state of the thermostat 13 that is provided as the control portion. With this configuration, there is no partition between the head water jacket 7 and the block water jacket 3. Thus, the flow of the coolant in the block water jacket 3 is suppressed using the difference in the pressure between the head water jacket 7 and the block water jacket 3. In contrast, in the second embodiment, the cover 22 is provided in the coolant passage between the head water jacket 7 and the block water jacket 3. Thus, when the engine 1 is cold, the inflow of the coolant from the head water jacket 7 into the block water jacket 3 is interrupted. Because the control valves 21 are formed using bimetal, the control valves 21 are opened according to the temperature of the coolant after the warming-up is completed. Thus, the coolant is permitted to flow into the block water jacket 3.

Figure 9A:
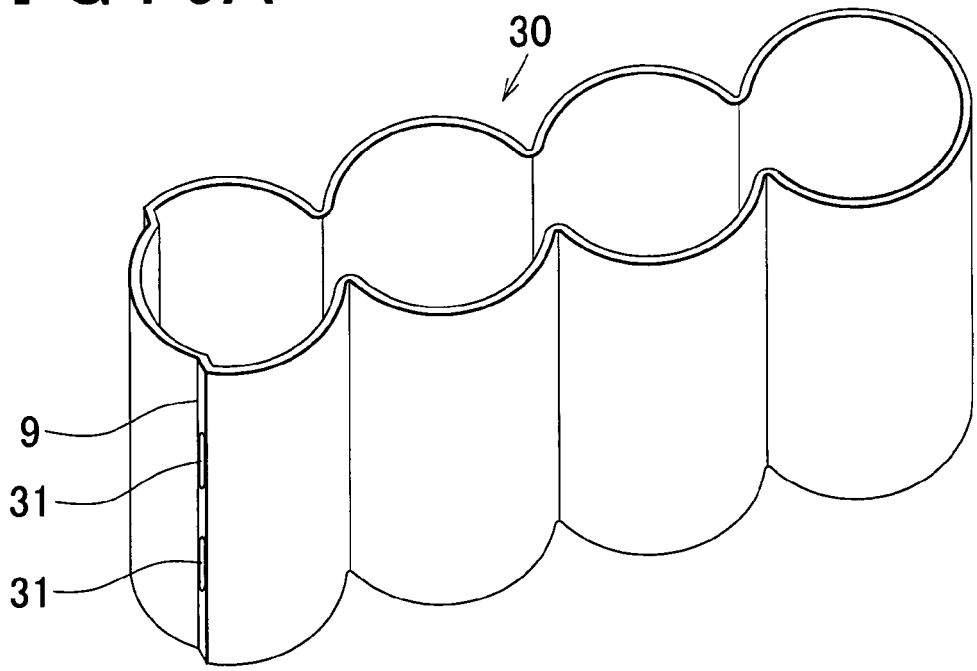
FIG. 9A is a perspective view showing a water jacket spacer according to a third embodiment.
Figure 9B:
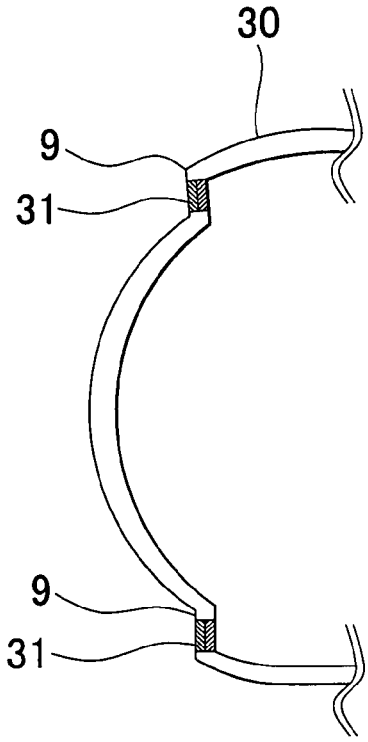
FIG. 9B is a partial enlarged view showing flow-directing plates and an area near the flow-directing plates.

A third embodiment of the invention will be described. The configuration in the third embodiment is the same as the configuration in the first embodiment, except that open/close valves 31 are provided in the flow-directing plates 9 of a water jacket spacer 30, as shown in FIGS. 9A and 9B. The open/close valves 31, which are formed using bimetal, are opened/closed according the temperature of the coolant.

When the temperature of the coolant is increased, the open/close valves 31 are opened. Then, after the coolant passes through the coolant inlet 5, the coolant flows into the coolant inflow portion 11 without passing through the head water jacket 7. This improves the effect of cooling the cylinder block 2. That is, immediately after the coolant is cooled by the radiator 12, the coolant flows in the entire area of the block water jacket 7. This ensures high cooling effect.

The above-described embodiments are example embodiments for carrying out the invention. The invention is not limited to the above-described embodiments. These embodiments may be modified in various manners within the scope of the invention. Further, it is evident from the above description that the invention may be realized in other various embodiments within the scope of the invention. For example, the control valves 21 in the second embodiment and the open/close valves 31 in the third embodiment are formed using bimetal that is operated according to the temperature of the coolant. To execute a more accurate control, a heater may be provided, and control means may operate the bimetal by controlling the supply of electric power to the heater according to the temperature of the coolant.

While the invention has been described with reference to exemplary embodiments thereof, it should be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. An engine cooling apparatus comprising:

a coolant inlet of a block water jacket formed in a cylinder block, wherein coolant is introduced into the block water jacket through the coolant inlet;

a flow-directing plate that is disposed in the block water jacket at a position downstream of the coolant inlet, and that directs the coolant, which has been introduced into the block water jacket through the coolant inlet, toward a head water jacket; and a control portion that controls inflow of the coolant from the head water jacket into the block water jacket, wherein the flow-directing plate forms a part of a spacer in the block water jacket and the control portion is located at the spacer which lines the cylinders.

2. The engine cooling apparatus according to claim 1, wherein the spacer divides an inside of the block water jacket into a coolant introduction portion connected to the coolant inlet, and a coolant inflow portion into which the coolant flows from the head water jacket.

3. The engine cooling apparatus according to claim 1, wherein the control portion is a control valve that switches between a first circulation passage in which the coolant flows into the head water jacket, and then flows out of the head water jacket, and a second circulation passage in which the coolant flows into the block water jacket from the head water jacket, and then flows out of the block water jacket, according to a temperature of the coolant.

4. The engine cooling apparatus according to claim 2, wherein the control portion is a control valve that is provided in a coolant passage through which the coolant flows into the coolant inflow portion, and that controls the inflow of the coolant into the coolant inflow portion according to a temperature of the coolant.

5. The engine cooling apparatus according to claim 4, wherein the control valve is formed using bimetal.

6. The engine cooling apparatus according to claim 1, wherein the flow-directing plate is provided with an open/close valve that is opened/closed according to a temperature of the coolant.

7. The engine cooling apparatus according to claim 6, wherein the open/close valve is formed using bimetal.

8. An engine cooling apparatus comprising:

a coolant inlet of a block water jacket formed in a cylinder block, wherein coolant is introduced into the block water jacket through the coolant inlet;

a flow directing plate that is disposed in the block water jacket at a position downstream of the coolant inlet, and that directs the coolant, which has been introduced into the block water jacket through the coolant inlet, toward a head water jacket; and a control portion that controls inflow of the coolant from the head water jacket into the block water jacket, wherein the flow directing plate forms a part of a spacer which lines the cylinders in the block water jacket, wherein the spacer divides an inside of the block water jacket into a coolant introduction portion connected to the coolant inlet, and a coolant inflow portion into which the coolant flows from the head water jacket.

9. The engine cooling apparatus according to claim 8, wherein the control portion is a control valve that switches between a first circulation passage in which the coolant flows into the head water jacket, and then flows out of the head water jacket, and a second circulation passage in which the coolant flows into the block water jacket from the head water jacket, and then flows out of the block water jacket, according to a temperature of the coolant.

* * * * *

UNITED STATES PATENT AND TRADEMARK OFFICE

CERTIFICATE OF CORRECTION

PATENT NO. : 7,647,900 B2
APPLICATION NO. : 11/806765
DATED : January 19, 2010
INVENTOR(S) : Kunihiko Hayashi et al.

It is certified that error appears in the above-identified patent and that said Letters Patent is hereby corrected as shown below:

In the Title page:

Change "(73) Assignee: Toyota Jidosha Kabuhsiki Kaisha" to

--(73) Assignee: Toyota Jidosha Kabushiki Kaisha--.

Signed and Sealed this

Twentieth Day of April, 2010

David J. Kappos

David J. Kappos
*Director of the United States Patent and Trademark Office*